United States Patent [19]

Kondur, Jr.

[11] 4,242,005

[45] Dec. 30, 1980

[54] INKED RIBBON ADVANCE AND REVERSE MECHANISM INCLUDING A PAWL HAVING DIFFERENT SIZE TEETH

[75] Inventor: Nicholas Kondur, Jr., Riverton, Wyo.

[73] Assignee: C. Itoh Electronics, Inc., Los Angeles, Calif.

[21] Appl. No.: 912,090

[22] Filed: Jun. 2, 1978

[51] Int. Cl.[3] ..... B41J 33/40

[52] U.S. Cl. ..... 400/220.1; 400/229; 400/232; 400/233; 400/236.1

[58] Field of Search ..... 400/120, 124, 204, 218, 400/220, 220.1, 223, 229, 232, 233, 234, 236, 236.1; 101/93.05, 93.48, 336

[56] References Cited

U.S. PATENT DOCUMENTS

| | | | |
|---|---|---|---|
| 940,814 | 11/1909 | Kuntzler | 400/220.1 X |
| 1,127,931 | 2/1915 | Smith | 400/220.1 X |
| 2,978,090 | 4/1961 | Brandt | 400/234 X |
| 3,677,486 | 7/1972 | Findlay | 400/220 X |
| 3,825,103 | 7/1974 | Riley | 400/236 X |
| 3,855,448 | 12/1974 | Hanagata et al. | 400/120 X |
| 3,880,271 | 4/1975 | Hebron | 400/220.1 X |
| 3,986,594 | 10/1976 | Kondur, Jr. | 400/218 X |
| 4,004,671 | 1/1977 | Kondur, Jr. | 101/93.05 X |
| 4,062,436 | 12/1977 | Kondur, Jr. et al. | 400/124 |
| 4,070,963 | 1/1978 | Weaver | 101/93.48 X |

*Primary Examiner*—Ernest T. Wright, Jr.
*Attorney, Agent, or Firm*—W. Edward Johansen

[57] ABSTRACT

The present invention is an improved pawl for use in combination with an inked ribbon advance and reverse mechanism which includes a plate member, a pair of ribbon spools which are disposed on the surface of the plate member and are mechanically coupled thereto so that they can rotate bidirectionally, a pair of ratchet wheels, each having teeth disposed in an opposite direction and each being mechanically coupled to one of the pair of ribbon spools, and a mounting device for mechanically coupling the improved pawl to the plate member. The improved pawl includes an elongated member having a pair of ends, each end having a plurality of teeth which are disposed along the surface of the elongated member that mechanically engages one of the ratchet wheels. The elongated member is pivotally coupled to the mounting device which includes a pivot pin which mechanically couples the elongated member to the mounting device by means of a pair of springs. The mounting device is a sliding member which is mechanically coupled to the pivot pin with the improved pawl being coupled to the plate member through the sliding member and a coupling device for slidably coupling the sliding member to the plate member so that the sliding member can move differentially in parallel juxtaposition to the plate member and the ribbon spools.

3 Claims, 4 Drawing Figures

INKED RIBBON ADVANCE AND REVERSE MECHANISM INCLUDING A PAWL HAVING DIFFERENT SIZE TEETH

BACKGROUND OF THE INVENTION

1. Field of the Invention

The present invention relates to an inked ribbon advancement mechanism and more particularly to an advancement mechanism which incrementally advances an inked ribbon.

2. Description of the Prior Art

U.S. Pat. No. 3,986,594, entitled Serial Impact Calculator Printer, issued to Nicholas Kondur, Jr., on Oct. 19, 1976, teaches a wire matrix print head for a dot matrix printer that employs a plurality of electromagnetically actuated print wires converging forwardly through a wire guide member for termination at their leading ends in confronting and adjacent relation to the print medium. The trailing ends of the print wires are mounted within electromagnetic actuators for movement in a lengthwise direction to cause their leading ends to be driven into the print medium to form a series of even impressions or dots thereon.

A ribbon spool drive member coordinates the advancement of the inked ribbon with the print head travel and it is mounted on the print head to selectively engage ratchet teeth on a ratcheted ribbon spool at the end of each margin as the print head traverses the print medium. Each ribbon spool is constructed and arranged so that it exerts not only the proper tension on the inked ribbon on its passage between the print head and the print medium but also permits the selective advancement of the ribbon spool in response to its engagement by a ribbon spool drive member. The ribbon spool drive member is constructed and arranged so that it is selectively engageable with one ribbon spool at a time in order to advance the inked ribbon in one direction only until it is fully wound upon one of the ribbon spools and thereafter to be reversed to selectively engage the other ribbon spool in order to cause reverse travel of the inked ribbon.

The U.S. Pat. No. 3,825,103, entitled High-Speed Printer Having Improved Ribbon Driving, Reversing and Tensioning Mechanism, issued to Arthur F. Riley on July 23, 1974, teaches a high-speed impact printer which has an improved ribbon driving, reversing, and tensioning mechanism that is jam-proof, of compact-simplified construction, reliable and substantially maintenance free in operation. By being compact, the drive mechanism may be centrally located at the front of the print head so as to facilitate spool and/or inked ribbon replacement. The drive mechanism, through the use of two sets of pivotally mounted, two-stage biased planetary coupling gears, effects gradual rotational engagement and disengagement of the selectively coupled driving and driven gears of the drive mechanism. This results in minimal gear wear, and produces smooth, automated reversal of ribbon travel, while the latter is continuously maintained under uniform tension.

Because most dot matrix printers are of a high-speed nature, it precludes an incremental movement of the inked ribbon in view of the fact that normally there would be insufficient ink (or carbon) on the inked ribbon to allow repetitive impacting of the rods of a print head against common discrete areas during each index dwell period. Accordingly, the ribbon advancement in high-speed printers cannot be accomplished simply as a by-product of the type-bar mechanical motion of conventional typewriters. Rather, the ribbon spool drive mechanism must be of a type that slowly, but continuously, advances the inked ribbon along and between the aligned arrays of the rods of the print head, and under constant tension so as to maintain the inked ribbon in alignment therewith. Ribbon reversal, of course, must also be effected automatically in any high volume printing application. In order to efficiently utilize all of the ink (or carbon) on the inked ribbon, it is also very advantageous that the entire length of the inked ribbon be exposed to the rods of the print head impacting at some point in time during travel of the inked ribbon therepast in both directions.

U.S. Pat. No. 3,677,486, entitled Uniform Ribbon Feed Apparatus, issued to Campbell Findlay on July 18, 1972, teaches a ribbon feed apparatus in which a reciprocating pawl engages a ratcheted takeup ribbon spool. A supply ribbon spool feeds an inked ribbon to the ratcheted takeup ribbon spool incrementally with each driving stroke of the pawl. In order to achieve a nearly constant speed of ribbon feed, the apparatus combines a camming lug with the pawl which detects the changing diameter of the inked ribbon on the takeup spool and reduces the angular distance that the pawl is engaged with the ratcheted takeup ribbon spool as the ribbon diameter increases.

The inked ribbon is interposed between a print medium such as paper and a raised font on an impacting surface of one of the rods of a print head. The impact of the rods of the print head depletes the ink supply in the impacted area of the inked ribbon. Capillary action replenishes the impacted area from adjacent ribbon areas of the inked ribbon so that it can make another print of sufficient quality from the same area. To prevent reprinting on the impacted area of the inked ribbon used by a previous print, the inked ribbon is moved before the next print impact is undertaken. In determining the distance the inked ribbon should move between the impacts of the rods of the print head, one must consider the sufficiency of the reservoir of ink remaining to replenish the depleted area of the inked ribbon. Printing in close succession on the same area of the inked ribbon either delays the replenishment of the ink in the impacted portion of the inked ribbon or inhibits it altogether. However, moving the inked ribbon for relatively great distances at high speed between prints is wasteful and also presents timing and stress difficulties in a high print rate machine.

SUMMARY OF THE INVENTION

In view of the foregoing factors and conditions characteristic of the prior art, it is an object of the present invention to provide an improved inked ribbon advance and reverse mechanism which advances an increment of inked ribbon an appreciable distance.

It is another object of the present invention to provide an improved inked ribbon advance and reverse mechanism and ribbon spools which are mechanically coupled to a print head so that they move together across each print line to provide increased visibility thereof.

It is still another object of the present invention to provide an improved inked ribbon advance and reverse mechanism, having a pawl and ratchet assembly, that decreases the force necessary to be applied to the pawl thereby eliminating a premature reversing of the mechanism which would result in not all of the inked ribbon being used.

It is yet another object of the present invention to provide a compact inked ribbon advance and reverse mechanism.

In accordance with an embodiment of the present invention, an improved pawl for use in combination with an inked ribbon advance and reverse mechanism which includes a plate member, a pair of ribbon spools which are disposed on the surface of the plate member and are mechanically coupled thereto so that they can rotate bidirectionally, a pair of ratchet wheels, each having teeth disposed in an opposite direction and each being mechanically coupled to one of the pair of ribbon spools, and a mounting device for mechanically coupling the improved pawl to the plate member is described. The improved pawl includes an elongated member having a pair of ends, each end having a plurality of teeth which are disposed along the surface of the elongated member that mechanically engages one of the ratchet wheels. The elongated member is pivotally coupled to the mounting device which includes a pivot pin which mechanically couples the elongated member to the mounting device by means of springs. The mounting device is a sliding member which is mechanically coupled to the pivot pin with the improved pawl being coupled to the plate member through the sliding member and a coupling device for slidably coupling the sliding member to the plate member so that the sliding member can move differentially in parallel juxtaposition to the plate member and the spools. The inked ribbon advance and reverse mechanism is used in a printer which includes a print head that is mechanically coupled to the plate member so that the print head travels in concert with the ribbon spools.

The features of the present ivnention which are believed to be novel are set forth with particularity in the appended claims.

Other objects and many of the attendant advantages of this invention will be more readily appreciated as the same becomes better understood by reference to the following detailed description and considered in connection with the accompanying drawing in which like reference symbols designate like parts throughout the figures.

DESCRIPTION OF THE PREFERRED EMBODIMENT

Figure 1:
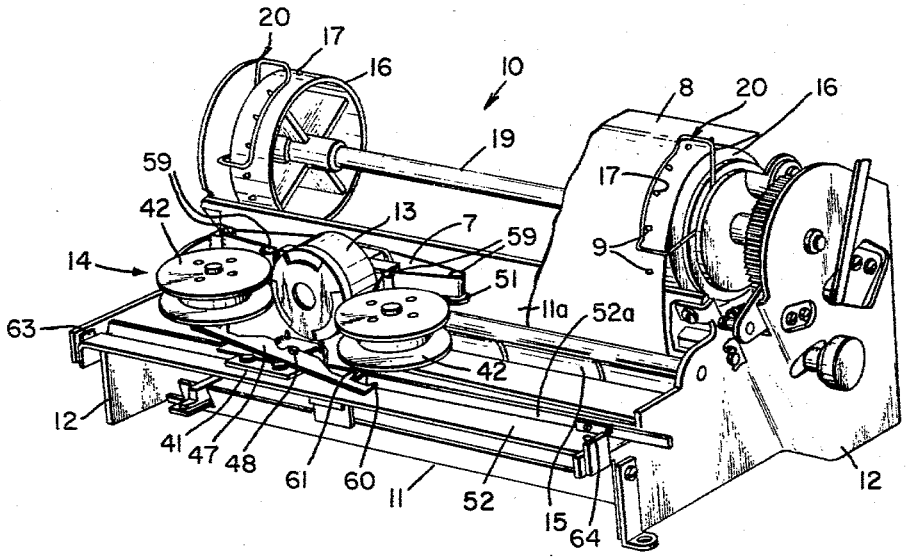
FIG. 1 is a perspective view of a printer which includes a frame, a print head and a platen for use in combination with an inked ribbon advance and reverse mechanism that has been constructed in accordance with the principles of the present invention.

In order to best understand the present invention it is first necessary to read the following description of a printer which is to be used in combination with the present invention and also to refer to the figures in the accompanying drawing. Referring to FIG. 1 a printer 10 includes a frame 11 having a platen **11*a*, a pair of side plates 12 and a print head 13 which is adapted to travel laterally across the front of the frame 11. The print head 13 uses an inked ribbon 7 and is of a type which is generally taught in U.S. Pat. No. 4,004,671, entitled Wire Matrix Print Head, issued to Nicholas Kondur, Jr., on Jan. 25, 1977. Other U.S. Patents that teach similar print heads include: No. 4,070,963; No. 3,986,594; and No. 4,062,436. The printer 10 also includes an inking apparatus 14 which is mechanically coupled to the print head 13 in order to provide ink for printing onto a print medium 8 and a timing shaft 15 which is rotatably coupled to the frame 11 between the pair of side plates 12 and which is mechanically coupled to the print head 13 and the inking apparatus 14 to drive them in concert across the front of the frame 11. The print medium 8 may be paper with sprocket holes 9 spaced a standardized distance apart along its borders. The printer 10 further includes a pair of sprockets 16 which are disc-shaped members each of which has a plurality of pins 17 which are disposed on its cylindrical sidewall and are spaced apart the same distance as are the sprocket holes 9 of the paper 8 and also has a disc-shaped hub 18 and a sprocket shaft 19 which is rotatably coupled to the frame 11 between the pair of side plates 12 and which mechanically couples each of the sprockets 16 adjacent to one of the side plates 12 and a media guide 20 which is rotatably coupled to the disc-shaped hub 18 of the sprocket 16 so that the print medium 8 is disposed between it and the cylindrical sidewall of the sprocket 16 and it is engaged by the pins 17 thereof through its sprocket holes 9**.

In order to further understand the present invention it is necessary to refer to U.S. Pat. No. 3,986,594 and a decription therein of the ribbon advance mechanism wherein the inked ribbon 7 is advanced between the ribbon spools under the control of the toggle arm which is shiftably mounted on the print head 13.

Referring to FIG. 1 the inking apparatus 14 is similar to the one taught in U.S. Pat. No. 3,986,594 entitled Serial Impact Calculator Printer, issued to Nicholas Kondur, Jr. on Oct. 19, 1976.

Figure 2:
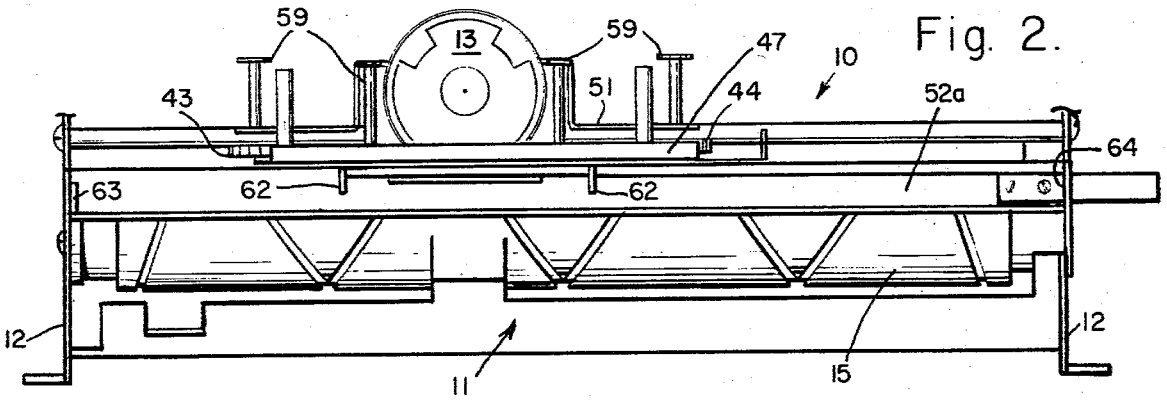
FIG. 2 is a front elevational view of the printer of FIG. 1 showing an improved pawl of the inked ribbon advance and reverse mechanism.
Figure 3:
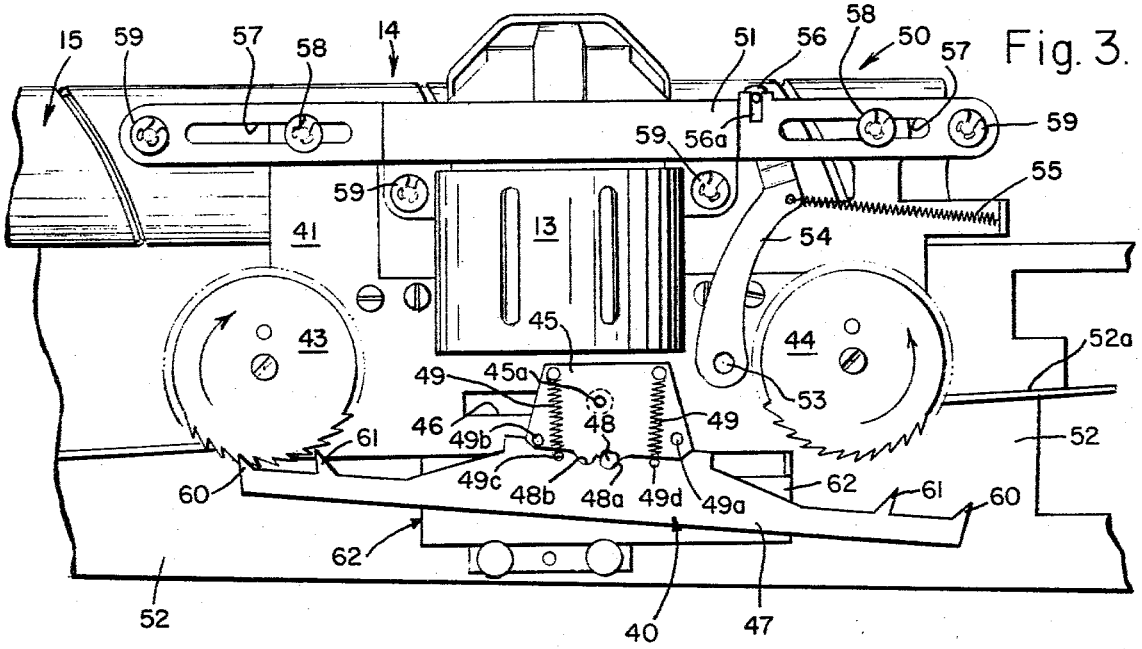
FIG. 3 is a top plan view of the inked ribbon advance and reverse mechanism of the printer of FIG. 1 showing the interaction between the improved pawl and a pair of ratchet wheels of inked ribbon advance and reverse mechanism.

Referring now to FIG. 2 in conjunction with FIG. 1 and FIG. 3 the inking apparatus 14 includes an inked ribbon advance and reverse mechanism 40 which is mounted on a plate member 41 and which travels in concert with the print head 13 across the front of the frame 11 of the printer 10. The inked ribbon advance and reverse mechanism 40 includes a pair of ribbon spools 42 which are rotatably coupled to the plate member 41 so that the ribbon spools 42 can rotate bidirectionally in order to dispense an increment of inked ribbon 7. A first ratchet wheel 43 has teeth which are disposed in a particular direction and is mechanically coupled to one of the ribbon spools 42 in axial alignment therewith. A second ratchet wheel 44 has teeth disposed in an opposite direction to the teeth of the first ratchet wheel 43 and is mechanically coupled to the other ribbon spool 42 in axial alignment therewith. The inked ribbon advance and reverse mechanism 40 also includes a sliding member 45 which is adapted to slide on a rivet 45*a* (shown in FIG. 4) within a slot 46 in the plate member 41 and an improved pawl 47 which has a plurality of teeth 60 and 61, which increase in height from each end, disposed at each end and which is connected to the sliding member 45 by a pivot pin 48 which is mechanically coupled to the sliding member 45 within one of a pair of shallow grooves 48*a* and 48*b* in the improved pawl 47 adjacent to its center line. It is not necessary to have the print head 13 and the inking apparatus 14 travel in concert in order to gain the advantages which are provided by a plurality of teeth 60 and 61 at each end of the improved pawl 47 rather than a single tooth at each end thereof. Among the advantages of having a plurality of teeth 60, 61 is that the angle of contact between the pawl 47 and the ratchet wheel 43 or 44 is reduced. Another advantage of the plurality of teeth 60, 61 of the improved pawl 47 is that they provide more rotational advancement of the ribbon spools 42 thereby providing a larger increment of inked ribbon 7 for each advancement. This larger increment of inked ribbon 7 is important in an eighty column line printer. The plurality of teeth 60, 61 increase in height as they move toward the center line of the improved pawl 47 because each successive tooth 61 must be taller than the previous tooth 60 in order to engage the ratchet wheel 43 or 44.

If the print head 13 and the inking apparatus 14 did not move in concert the operation of the inked ribbon advance and reverse mechanism 40 would be similar to that described above in U.S. Pat. No. 3,986,594 and which has the pivot pin 48 mounted on the plate member 41. However, in the present invention, where they must move in concert, the operation of the inked ribbon advance and reverse mechanism 40 requires the use of the sliding member 45. The sliding member 45 is slidably coupled to the plate member 41 through a slot 46 therein and the print head 13 so that the improved pawl 47 may move differentially with respect to the ribbon spools 42. The inked ribbon advance and reverse mechanism 40 further includes a pair of springs 49 which resiliently couple the improved pawl 47 to the plate member 41 so that the improved pawl 47 is pivotally coupled to the pivot pin 48 which is affixed to the sliding member 45.

The inking apparatus 14 also includes an inked ribbon advancement mechanism 50 for advancing the increment of inked ribbon 7 continuously in response to the movement of the print head 13 so that no portion of the increment of inked ribbon 7 is used more than twice in any one printing cycle thereof. Referring still to FIG. 3 the inked ribbon advancement mechanism 50 includes a slidable member 51 and a cam member 52. The slidable member 51 is adapted to position the increment of inked ribbon in front of the print head 13 adjacent thereto and is slidably coupled to the print head 13 so that it can move in juxtaposition direction thereby moving differentially to the print head 13 and in response thereto. The cam member 52 is a flat, elongated trapezoid one of the non-parallel sides of which has a flat surface 52*a*.

Still referring to FIG. 3 the inked ribbon advancement mechanism 50 also includes the cam member 52 which is disposed between the side plates 12, a cam coupling member 53 which is adapted to slidably travel along the flat surface 52*a* of the cam member 52 and a pivot arm 54 which is fixedly coupled to the cam coupling member 53 and which is pivotally coupled to the plate member 41. A spring 55 resiliently couples the pivot arm 54 to the plate member 41. The pivot arm 54 has a pin 56 which is adapted to slidably and pivotally couple the pivot arm 54 to a slot 56*a* in the slidable member 51. The slidable member 51 has a pair of slots 57 which are slidably coupled to a pair of pins 58 so that the slidable member 51 may slide in juxtaposition direction to the print head 13 on the pair of pins 58 which are fixedly coupled to the plate member 41. The inked ribbon advancement mechanism 50 further includes a set of four roller-pins 59 two of which are fixedly coupled to the slidable member 51 and two of which are fixedly coupled to the plate member 41. The increment of inked ribbon 7 is disposed contiguous to the four roller-pins 59.

Figure 4:
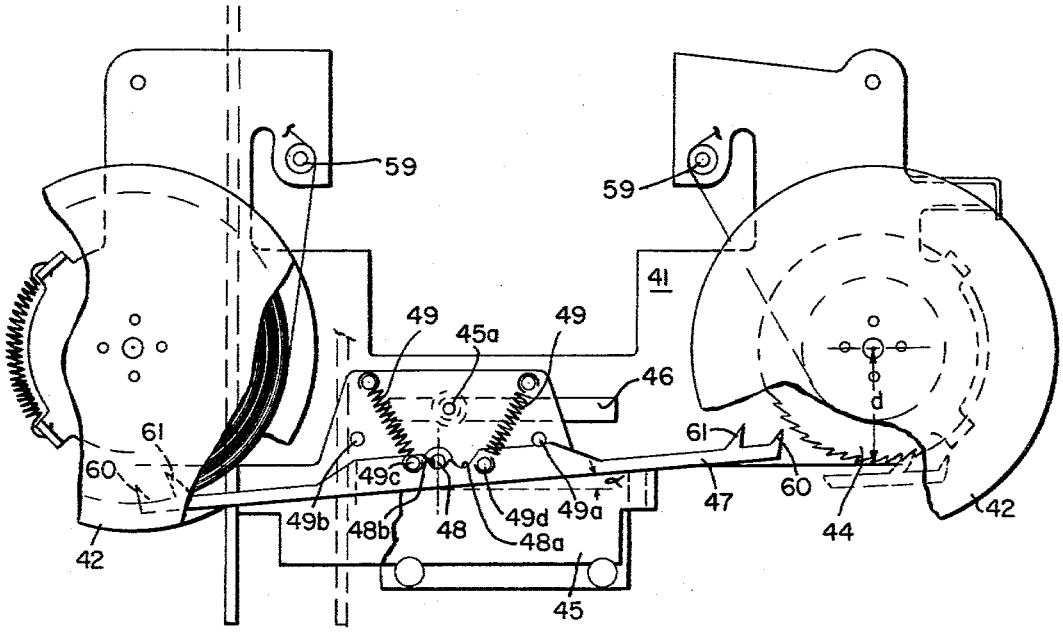
FIG. 4 is a top plan view of the inked ribbon advance and reverse mechanism of the printer of FIG. 1 showing the plurality of teeth at one end of the improved pawl engaging the teeth of one of the ratchet wheels.

Referring now to FIG. 4, when the pivot pin 48 is in the left-hand groove 48*b*, the ribbon feed pawl 47 is held in position by the springs 49 which hold the improved pawl 47 against a pin 49*b* at an angle $\alpha$ from the horizontal. This occurs because the distance from a spring anchor pin 49*d* on the improved pawl 47 to the pivot pin 48 is greater on the right side of the pivot pin 48 than from a spring anchor pin 49*c* on the left side of the pivot pin 48. It can be seen that if the improved pawl 47 were to be shifted to the left such that the right hand groove 48*a* were to be occupied by the pivot pin 48 then the improved pawl 47 would limit on a pin 49*b* such that it would be angularly positioned in a similar position except with the angle $\alpha$ preceding clockwise from the horizontal instead of counterclockwise as shown in FIG. 4 because both pins 49*a* and 49*b* are the same distance from the pivot pin 48 in both the x and the y directions. If a force were of sufficient magnitude, then the improved pawl 47 would be forced to the left causing the pivot pin 48 to move with respect to the groove 48*b* which it occupies into the other groove 48*a*. The springs 49 resiliently retain the pivot pin 48 in the groove 48*a* or 48*b*. Therefore, the tension of the springs 49 determines how much force will be required in order to "shift" the improved pawl 47.

The sliding member 45 is free to slide both left and right and is constrained from other movement by the slot 46 in the plate member 41. The sliding member 45 is caused to slide when the plate member 41 is driven from side to side of the printer 10 by the drive mechanism.

The preferred embodiment of the improved pawl 47 has a pair of first engaging teeth 60 and a pair of second engaging teeth 61 which are mechanically coupled to the two ratchet wheels 43 and 44. The improved pawl 47 is pivotally coupled to the sliding member 45 through the pivot pin 48. The sliding member 45 is slidably coupled to the plate member 41. The sliding member 45 has a pair of limit bars 62. At each side of the frame 11 there is a limit stop 63 or 64 which, as one of the limit bars 62 of the sliding member 45 approaches it, stops the sliding member 45, yet allows the plate member 41 to continue to move toward the side of the frame 11. The first engaging tooth 60 of the improved pawl 47 engages the ratchet wheel 43 or 44 as the plate member 41 approaches the side of the frame 11 and as the plate member 41 moves away from the side of the frame 11 and the first engaging tooth 60 of the improved pawl 47 rotates the ratchet wheel 43 or 44. The movement imparted to the improved pawl 47 in this embodiment is at least 0.8 inches, when the sliding member 45 moves, the improved pawl 47 moves the same distance because the pivot pin 48 upon which the improved pawl 47 is located is rigidly fixed to the sliding member 45. When the improved pawl 47 is caused to move to the right due to the action of the drive mechanism the first tooth 60 of the improved pawl 47 will contact one of the teeth of the ratchet wheel 43 or 44 and cause the ribbon spool 42 to rotate counterclockwise cusing the inked ribbon 7 to be wound therearound it and the left-hand ribbon spool 42 to rotate also in a counterclockwise direction thereby unwinding the inked ribbon 7. At the end of its travel to the left, the improved pawl 47 will be in a position, which is shown by the phantom lines in FIG. 4, where it will rest until the drive mechanism drives the inking apparatus 14 to the right and at which time the limit bar 62 will strike the limit stop 64 of the side of the frame 11 and move the sliding member 45 to the left with respect to the plate member 41 thereby restoring it to its original position and "resetting" the improved pawl 47 so that the next movement of the inking apparatus 14 to the left will cause the improved pawl 47 to rotate the ribbon spool 42 and wind the inked ribbon 7 onto the right-hand ribbon spool 42. This operation will continue until the inked ribbon 7 on the left-hand ribbon spool 42 has completely unwound onto the right-hand ribbon spool 42. When the right-hand ribbon spool 42 is full the action of the drive mechanism on the sliding member 45 will force the first tooth 60 of the improved pawl 47 against the teeth of the ratchet wheel 43 which cannot rotate because it is coupled to the right-hand ribbon spool 42. The right-hand ribbon spool 42 cannot rotate because the inked ribbon 7 is completely unwound from the left-hand ribbon spool 42 onto the right-hand ribbon spool 42. The force of the drive mechanism through the inking apparatus 40 on the improved pawl 47 will cause the pivot pin 48 which is pivotally coupled to the right-hand groove **48*a* of the improved pawl 47 to move into the left-hand groove 48*b* of the improved pawl 47 and become pivotally coupled thereto. This will effect the shifting of the improved pawl 47 and will permit the winding of the inked ribbon 7 onto the left-hand ribbon spool 42 due to the action of the opposite tooth 60 of the improved pawl 47 on the teeth of the ratchet wheel 44. The amount of the inked ribbon 7 wound upon the ribbon spool 42 for each cycle of the mechanism is partially dependent upon the amount of rotation of the ribbon spool 42. This is dependent upon the distance that the improved pawl 47 travels with respect to the ribbon spool 42 and the ratchet wheel 43 or 44. Referring still to FIG. 4, there is a limitation upon the rotation of the ratchet wheel 43 or 44 because the point of contact between the improved pawl 47 and the ratchet wheel 43 or 44 will cause varying forces to the first and second teeth 60 and 61 of the improved pawl 47. As angle $\alpha$ increases and in fact if angle $\alpha$ increases beyond forty degrees (40°) the force on the improved pawl 47 due to the ratchet wheel 44 will exceed that which the springs 49 provide and cause a premature shifting. The improved pawl 47 will disengage itself from ratchet wheel 43 or 44 if the movement of the improved pawl 47 is excessive. Therefore with a one-tooth pawl the rotation of the ribbon spool 42 has a practical maximum limit of about sixty degrees (60°) of rotation. This invention eliminates these problems by adding a second tooth 61 with more teeth being added if necessary. First, the added second tooth 61 at each end of the improved pawl 47 permits a smaller angle $\alpha$ to be employed thereby reducing the force which is required to be exerted by the improved pawl 47, in order to rotate the ratchet wheel 43 or 44. Second, the added second tooth 61 also permits the full movement of the improved pawl 47 relative to the plate member 41, on which the ribbon spools 42 are mounted, to be employed in rotating the ribbon spool 42 by causing the second tooth 61 to engage prior to disengagement of the first tooth 60**.

From the foregoing it can be seen that an inked ribbon advance and reverse mechanism has been described. Accordingly it is intended that the foregoing disclosure and showing made in the drawing shall be considered only as illustrations of the present invention. Furthermore, it should be noted that the sketches are not drawn to scale and that distances of and between the figures are not to be considered significant. The invention will be set forth with particularity in the appended claims.

What is claimed is:

1. An improved pawl for use in combination with an inked ribbon advance and reverse mechanism which includes:

a. a first ribbon spool from which an inked ribbon is unwound;

b. a first ratchet wheel having teeth disposed in a particular direction which is axially aligned with the first ribbon spool and which is rigidly coupled thereto so that the first ribbon spool and the first ratchet wheel rotate together;

c. a second ribbon spool onto which the inked ribbon is wound;

d. a second ratchet wheel having teeth disposed in the opposite direction of the teeth of the first ratchet wheel which is axially aligned with the second ribbon spool and which is rigidly coupled thereto so that the second ribbon spool and the second ratchet wheel rotate together;

e. mounting means for mounting said improved pawl so that said improved pawl may mechanically engage the teeth of one of the two ratchet wheels, said improved pawl comprising;

a. an elongated member having a pair of ends, each end having a plurality of teeth which are disposed along the surface of said elongated member and which are aligned so that the teeth mechanically engage the teeth of one of the two ratchet wheels, the teeth of said elongated member being arranged in a graduated series so that said teeth of said elongated member increase in height from each end to the center of said elongated member; and b. resilient coupling means for resiliently coupling said improved pawl to said mounting means.

2. An improved pawl according to claim 1 wherein said mounting means comprises:

a. a sliding member; and b. a pivot pin which is mechanically coupled to said sliding member wherein said improved pawl has a pair of grooves spaced apart from its center so that one or the other of the pair of grooves may be pivotally coupled to said pivot pin.

3. An improved pawl according to claim 2 wherein the inked ribbon advance and reverse mechanism also includes a plate member on which the first ratchet wheel and the second ratchet wheel is mounted and wherein said sliding member is slidably coupled to the plate member so that said sliding member can move in a parallel, juxtaposition direction with respect to the plate member thereby providing differential motion.

* * * * *